United States Patent [19]

Langen et al.

[11] Patent Number: 4,509,309

[45] Date of Patent: Apr. 9, 1985

[54] LOAD ORIENTING RECEPTACLES FOR CARTON LOADING MACHINES

[75] Inventors: Marinus J. M. Langen; Peter Guttinger, both of Rexdale, Canada

[73] Assignee: H. J. Langen & Sons Limited, Mississauga, Canada

[21] Appl. No.: 520,906

[22] Filed: Aug. 8, 1983

[51] Int. Cl.[3] ..... B65B 35/56; B65B 39/14

[52] U.S. Cl. ..... 53/142; 53/544; 53/237; 53/247; 53/252; 198/416

[58] Field of Search ..... 53/142, 143, 544, 252, 53/258, 247, 237; 414/781, 31; 198/416, 420

[56] References Cited

U.S. PATENT DOCUMENTS

| | | | |
|---|---|---|---|
| 1,062,848 | 5/1913 | Peterson | 53/142 |
| 2,439,883 | 4/1948 | Brown et al. | 53/142 |
| 3,193,981 | 7/1965 | Whitecar | 53/252 X |
| 3,290,857 | 12/1966 | Nydam | 53/142 X |
| 3,313,394 | 4/1967 | Mills et al. | 53/143 X |
| 3,763,626 | 10/1973 | Pinkepank et al. | 53/142 |
| 4,348,816 | 9/1982 | Arippol | 198/416 X |
| 4,351,141 | 9/1982 | Glorfield et al. | 53/237 X |

*Primary Examiner*—Horace M. Culver

*Attorney, Agent, or Firm*—Fetherstonhaugh & Co.

[57] ABSTRACT

A load orienting receptacle for a carton loading machine for use in loading lightbulbs into an open end of a carton. The receptacle has a trough in which a slipway extends to an open discharge end. The slipway has an open upper end for admitting a lightbulb to a load orienting portion thereof spaced inwardly from the discharge end. The load orienting portion has opposite sides which converge downwardly to form a downwardly directed laterally inclined chute. The opposite sides are spaced from one another a sufficient distance to support the bulbous end of a light bulb above the bottom of the trough while permitting the narrow end thereof to be laterally deflected as it passes downwardly along the chute to come to rest in the trough thereby to laterally offset the narrow end with respect to the bulbous end of the bulb prior to discharge through the open discharge end of the trough.

7 Claims, 4 Drawing Figures

Figures 1, 2:
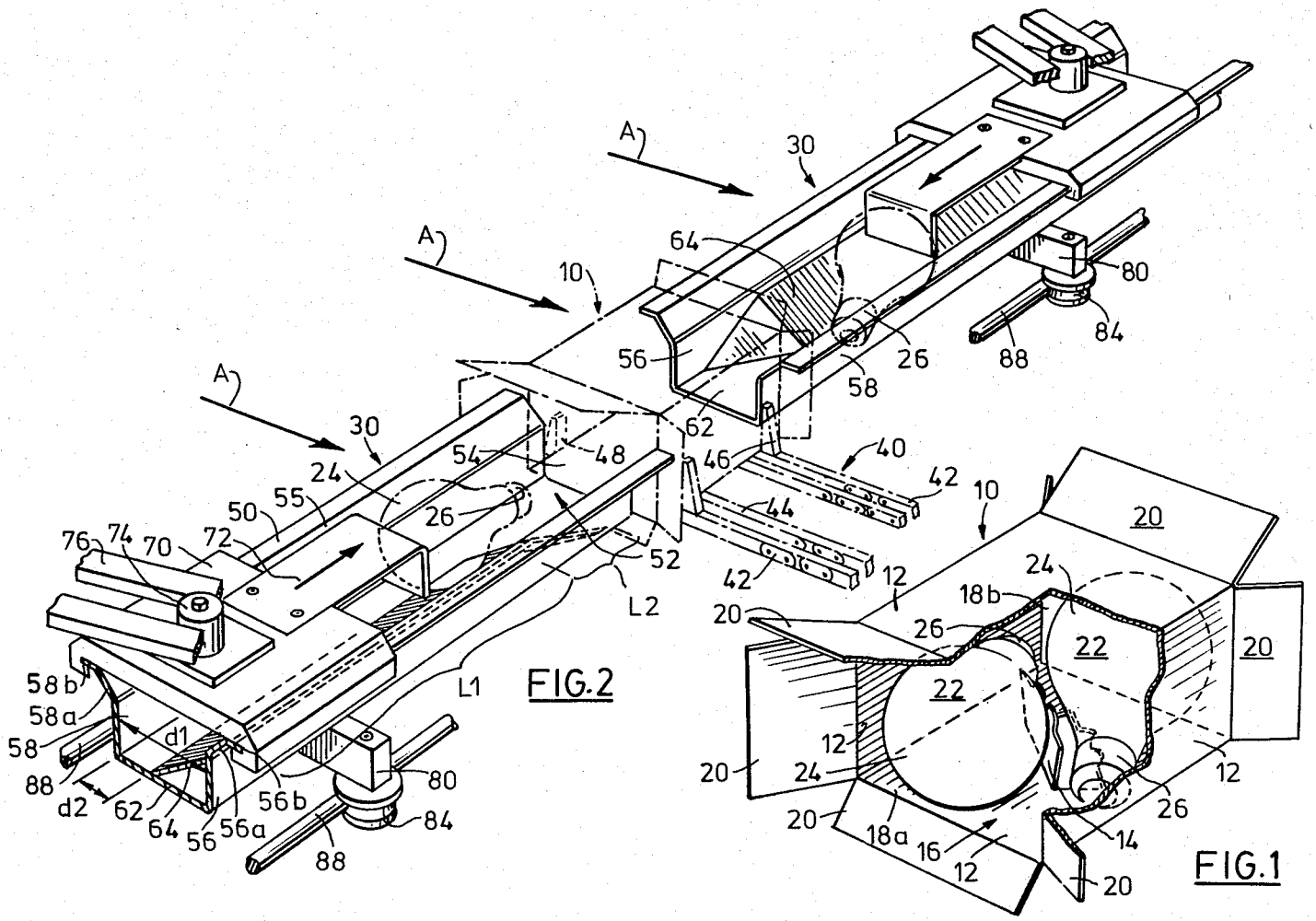

A
10
12
14
16
18a
18b
20
22
24
26
30
40
42
44
46
48
50
52
54
55
56
56a
56b
58
58a
58b
62
64
70
72
74
76
80
84
88
L1
L2
d1
d2

LOAD ORIENTING RECEPTACLES FOR CARTON LOADING MACHINES

This invention relates to carton loading machines. In particular, this invention relates to improvements in the loading receptacle of a carton loading machine and carton loading machines incorporating the improved receptacle.

PRIOR ART

Machines for end loading cartons are well known. In these known machines, the load is discharged into the carton through one open end.

Lightbulbs are commonly packaged in groups of two by inserting them into opposite ends of a carton with their narrow ends laterally offset. The mechanism which is conventionally used for locating lightbulbs in the conventional package is one in which a complex reciprocating arm structure is provided, the lightbulbs being secured to the arm by suction cups. The speed of operation of the conventional mechanism is limited by the complexity of the movement of the loading arm.

The complexity of the coventional lightbulb loading machine is such that they are expensive to manufacture and require considerable maintenance.

We have found that lightbulbs can be loaded into a conventional lightbulb carton by employing a carton end loading machine and providing a carton loader at opposite sides of the carton conveyor, the carton loaders each having load receptacles adapted to laterally offset the narrow ends of the bulbs with respect to one another prior to discharge into the carton.

It is therefore an object of the present invention to provide a trough for a carton loading machine which is adapted to laterally offset the leading end of the load prior to discharge into an end loading carton.

It is a further object of the present invention to provide a carton loading machine having carton loading receptacles located directly opposite one another on opposite sides of the carton conveyor.

SUMMARY OF INVENTION

According to one aspect of the present invention there is provided a load orienting receptacle for a carton loading machine for use in loading lightbulbs into an open end of a carton, the lightbulbs being of the type having a bulbous end and a narrow plug end, comprising a trough having a slipway extending longitudinally thereof to an open discharge end, said slipway having an open upper end for admitting a lightbulb to a load orienting portion thereof spaced inwardly from the discharge end, said load orienting portion having opposite sides which converge downwardly to form a downwardly directed laterally inclined chute, said opposite sides being spaced from one another a sufficient distance to support the bulbous end above the bottom of the trough while permitting the narrow end to be laterally deflected as it passes downwardly along the chute to come to rest in the trough thereby to laterally offset the narrow end with respect to the bulbous end of the bulb prior to discharge through the open discharge end of the trough.

According to yet another aspect of the present invention, there is provided a carton loading machine for end loading cartons having a carton conveyor mounted for longitudinal movement through a loading station, the improvement of a plurality of carton support means on said carton loading conveyor for supporting a carton with both ends thereof opening laterally one on either side of said loading conveyor, a pair of loading conveyors mounted one on either side of the carton conveyor and extending through said loading station, a plurality of loading receptacles mounted on said loading conveyor, said receptacles being arranged in oppositely disposed aligned pairs one on either side of said carton support means in said loading station, each of said loading receptacles having a discharge end opening toward said carton support means and a slipway extending to the discharge end, said slipway being adapted to laterally deflect the leading end of the load located in one receptable of a pair of receptacles out of alignment with the leading end of the load located in the other receptacle of said pair of receptacles prior to discharge of said loads through said discharge end, load discharging means mounting for longitudinal movement relative to said loading receptacles for driving said load longitudinally of said slipway through said discharge end and into said carton support means.

PREFERRED EMBODIMENT

Figure 3:
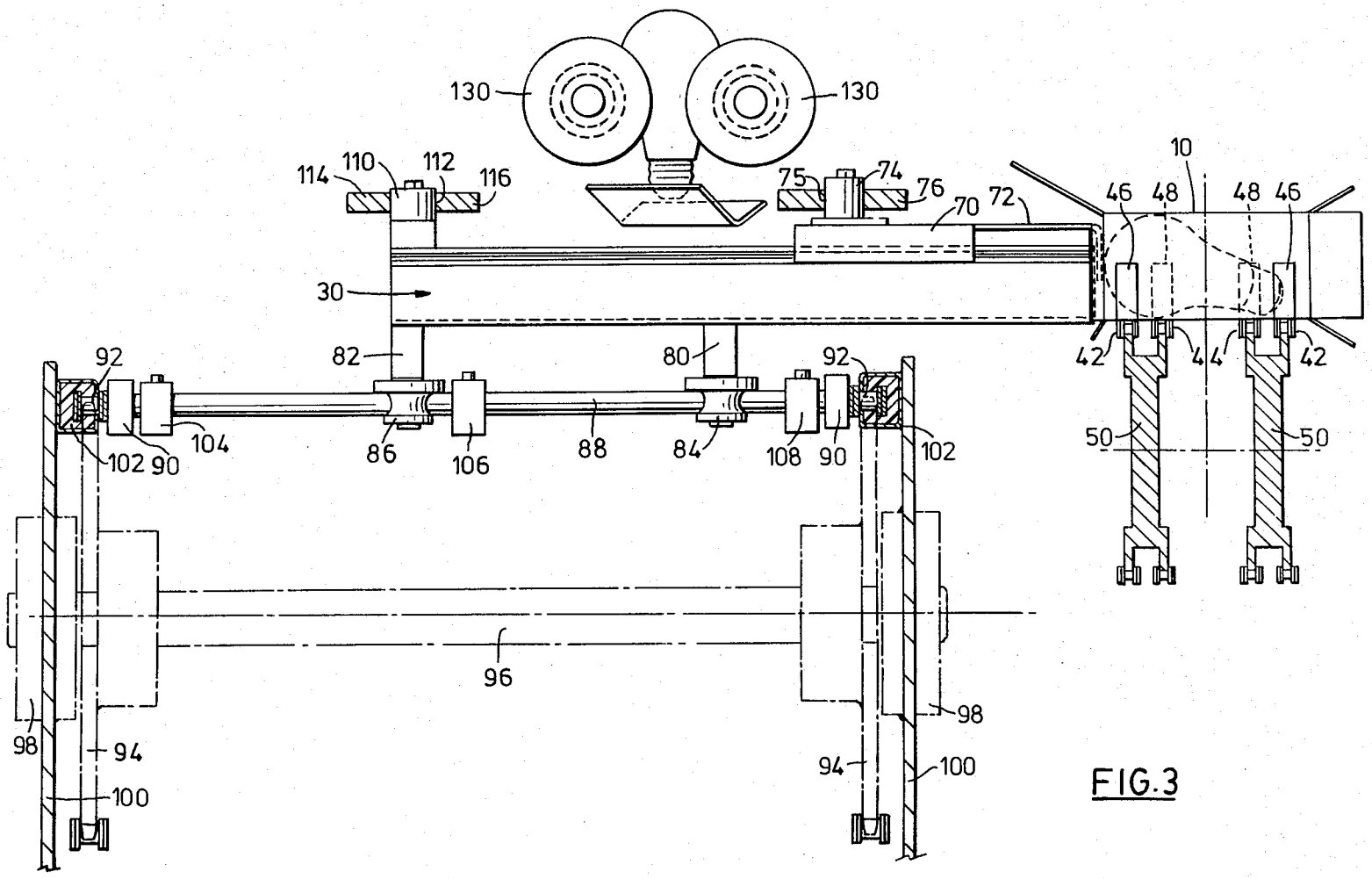
Figure 4:
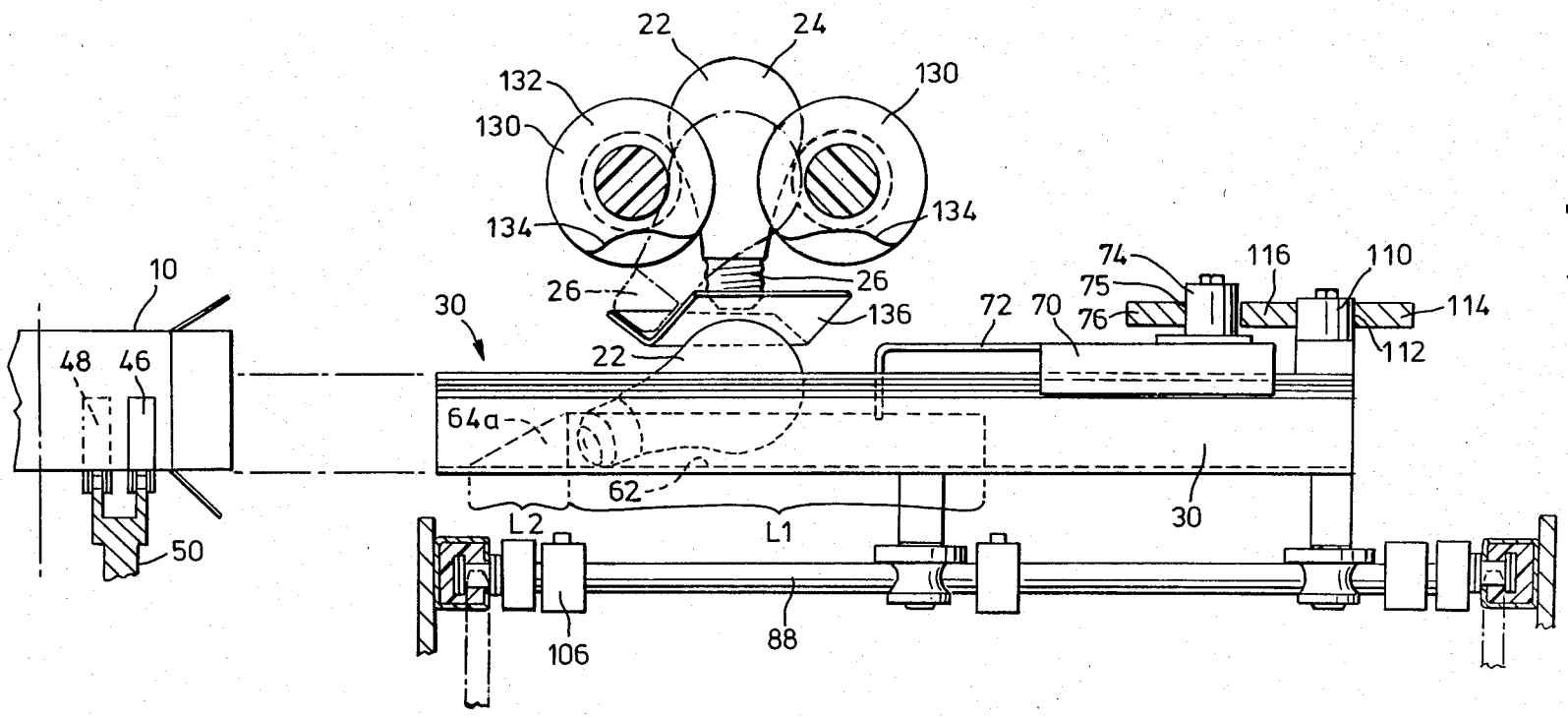

The invention will be more clearly understood after reference to the following detailed specification read in conjunction with the drawings wherein, FIG. 1 is a partially sectioned pictorial view of a lightbulb carton illustrating the position of the lightbulbs, FIG. 2 is a pictorial top view of a pair of loading receptacles mounted one on either side of a load conveyor of a carton end loading machine, FIG. 3 is a sectional side view of one half of the end loader of FIG. 1, FIG. 4 is a sectional side view similar to FIG. 3 showing the other half of the end loader upstream from the position shown in FIG. 3.

With reference to FIG. 1 of the drawings, the reference numeral 10 refers generally to an end loading lightbulb carton. The carton has four side walls 12. A divider panel 14 is struck from one of the side wall panels 12 and extends inwardly therefrom to divide the storage chamber 16 into two compartments 18*a* and 18*b*. End flaps 20 are hinged to the ends of the side walls 12 and are folded upon one another to close the storage chamber 16. The lightbulb package 10 is of a conventional type used for the purposes of storing conventional lightbulbs 22 of the type which have a bulbous end 24 and a narrow plug end 26. It will be noted that when the lightbulbs are mounted within the storage compartments 18*a* and 18*b*, the narrow socket ends 26 are laterally offset with respect to one another so as to bear against one side wall 12 of the carton. I have found that this lateral offset can be achieved by providing carton loading receptacles which are adapted to orient the lightbulbs prior to end loading of the cartons.

We have adapted carton end loading machines for the purposes of loading lightbulbs into conventional lightbulb storage compartments by providing a load orienting receptacle and by locating two such load orienting receptacles directly opposite one another. Two load orienting receptacles are illustrated in FIG. 2 of the drawings and are generally identified by the reference numeral 30. These receptacles 30 are located one on each side of a carton conveyor generally identified by the reference numeral 40.

The conveyor 40 includes a pair of chains 42 and a pair of chains 44 which are mounted on support rails 50

(FIG. 3). The chains 42 and 44 extend through the carton loading station. A plurality of stop members 46 are mounted at spaced intervals along the chains 42 and are arranged to be located in front of each carton 10. A plurality of stop members 48 are mounted at spaced intervals along the length of the chains 44 and are arranged to be located behind each carton 10. The stop members 46 and 48 serve to support and retain the carton 10 in an upright configuration. Suitable plowing rails (not shown) are provided in a conventional manner for ensuring that the flaps 20 are retained in the open configuration during passage of the carton 10 through the carton loading station.

Each of the load orienting receptacles 30 comprises a trough 50 which has a slipway 52 extending longitudinally thereof along which lightbulbs are driven for the purposes of orienting the lightbulb to the required position prior to discharge through the open end 54. The trough 52 has an open upper end 56 through which lightbulbs are admitted to the slipway 52. The trough 50 is formed with side walls 58 and 60 and a bottom wall 62. The side walls 56 and 58 have converging sections **58*a* and 56*a* which form an entranceway to the slipway. Flanges 56*b* and 58*b* are formed at the outer edges of the side walls 56 and 58 respectively. A ramp 64 extends downwardly and inwardly from the side wall 56 to the bottom wall 62. The ramp 64 has a first portion extending over the length L1 which serves to provide a load orienting portion of the slipway. The ramp 62 decreases in size progressively over the length L2 to form a load seating portion of the slipway 52. The side wall 58 is spaced from the side wall 56 a distance D1 which is sufficient to permit the bulbous end 24 of a lighbulb to pass downwardly into the trough to come to rest on the ramp 64 at a position spaced above the bottom wall 62. The distance D2 between the lower edge of the ramp 62 and the opposite side wall 58 is sufficient to permit the narrow end 26 of the bulb to pass downwardly to come to rest upon the exposed portion of the bottom wall 62. Thus, it will be seen that the ramp 64 functions as a shute which serves to support the bulbous end 24 of a lightbulb above the bottom wall 62 while permitting the narrow end 26 to be deflected laterally as it moves downwardly to come to rest upon the exposed portion of the bottom wall 62 adjacent the side wall 58. Thus, the load orienting portion L1 of the receptacles located on opposite sides of the carton 10 serve to offset the narrow ends 26 of the oppositely disposed bulbs prior to discharge into the carton. Pusher members 70 are slidably mounted on the flanges 56*b* and 58*b* and have a pusher blade 72 which extends downwardly into the trough 52 through the open upper end 55 of the trough. The pusher members 70 have a conventional construction and have a follower 74 mounted in a track 76. The track 76 is arranged to cause the pushers 70 to move toward and away from the dischargeend 54** of the slipway.

As shown in FIG. 3 of the drawings, each of the troughs 30 has a pair of support brackets 80 and 82 extending downwardly from the underside thereof. Rollers 84 and 86 are mounted on the brackets 80 and 82 and are mounted on shafts 88. The shafts 88 are arranged in pairs, two shafts being provided to support each trough. Each pair of shafts 88 are connected by end brackets 90 and roller chains 92 connect a plurality of mounting brackets 90 to form the receptacle transporting conveyor which extends continuously through the loading station in a conventional manner. The conveyor is driven by sprockets 94 which engage the chains 92. The sprockets 94 are mounted on a shaft 96. The shaft 96 is journaled in bearings 98 which is supported by the frame 100 of the machine. Guide tracks 102 are mounted on the frame 100 and extend longitudinally through the loading station and provide a guide track support for the forward run of the receptacle transport conveyor system.

Stops 104, 106 and 108 are mounted on the shaft 88 and serve to limit the reciprocating movement of the receptacles 30. The receptacles 30 each have a guide roller 110 mounted for movement along a guide track 112 which is formed between guide rails 114 and 116. This form of guide track is conventionally used in end loading machines and serves to move the receptacles to and fro between the forward position illustrated in FIG. 3 and a retracted position illustrated in FIG. 4.

Lightbulbs 22 are loaded into the receptacles 30 by way of a pair of loading screws 130, each of which has a spiral groove 132 which terminates in a discharge opening 134. The grooves 132 are proportioned to support the bulbous end 24 of a lightbulb 22 with the narrow end 26 depending therebetween over a major portion of the length thereof. Toward the discharge end of the screws 132, the depth of the spiral groove 132 increases. A deflector channel member 136 is disposed below the screws 130 adjacent the discharge end thereof and serves to laterally deflect the narrow end 26 of the lightbulbs. The depth of the screws 132 increases progressively from the point at which the lightbulb makes contact with the deflector 136 so that the lightbulb is allowed to move to the position shown in broken lines in FIG. 4 immediately prior to discharge through the openings 134. Upon discharge from the screw conveyors 130, the lightbulb is permitted to drop into the load orienting portion L1 of the underlying receptacle 30. It has been found that the conventional lightbulb can withstand the impact of a short drop into the receptacles without any damaging effect.

In use, lightbulbs are fed to the loading station by means of the feeding screws 130 and are laterally inclined by engagement with the guide plate 136 immediately prior to discharge into the load orienting portion L1 of the slipway. As the lightbulbs slide down the chute formed by the ramp 64 into the slipway, the large bulbous end is supported above the bottom wall 62 while the narrow end 26 is laterally deflected toward the exposed portion of the bottom wall. As shown in FIG. 2 of the drawings, the receptacles 30 which are located on opposite sides of the carton 10 have their ramps 34 extending from opposite side walls such that the narrow end 26 of the lightbulb which is located in one receptacle, is laterally offset with respect to the narrow end of the lightbulb which is located in the other receptacle. This charging of the receptacles 30 occurs when the receptacles 30 and pusher members 70 are in the retracted position illustrated in FIG. 4 of the drawings. After the lightbulb has been positioned in the receptacle, further movement of the receptacles and the open carton 10 in the direction of the arrows A through the loading station causes the receptacles to be driven toward the open ends of the carton 10 by engagement of the follower 110 in the guide track 112. This movement will continue until the receptacle 30 is positioned as shown in FIGS. 2 and 3 of the drawings with the discharge end thereof closely adjacent the open end of the carton. When in this position, the cam track 75 is oriented to cause the follower 74 to move the pusher 72 from the retracted position shown in FIG. 4 to the forward position shown in FIG. 3. When the pusher 72 engages the lightbulb 22, it drives the lightbulb along the slipway and out of the bulb orienting portion L1 into the seating portion L2. As the bulb moves into the seating portion L2, the bulbous end 24 is lowered into engagement with the bottom wall 62 as it travels along the diminishing portion 64*a* of the ramp 64. This action serves to seat the bulb in the required position prior to discharge into the open end of the carton 10 so that the bulbs which are discharged from the oppositely disposed receptacles will enter the carton 10 out of alignment with one another so that they can be nested one on either side of the divider panel 14.

Further movement of the receptacles through the loading station causes the receptacles to be withdrawn and then a conventional flap closing mechanism may be used to close the ends of the carton to form a shipper package containing two lightbulbs.

From the foregoing, it will be apparent that the present invention permits the loading of lightbulbs simultaneously into each end of a sleeve compartment. This operation can be carried out at high speed. No complex reciprocating actuator mechanism is necessary to reorient the bulbs with the result that the carton loading operation can be carried out at high speed. These and other advantages of the methods and apparatus of the present invention will be apparent to those skilled in the art.

I claim:

1. A load orienting receptacle for a carton loading machine for use in loading lightbulbs into an open end of a carton, the lightbulbs being of the type having a bulbous end and a narrow plug end, comprising;

a trough having a slipway extending longitudinally thereof to an open discharge end, said slipway having an open upper end for admitting a lightbulb to a load orienting portion thereof spaced inwardly from the discharge end, said load orienting portion having opposite sides which converge downwardly to form a downwardly directed laterally inclined chute, said opposite sides being spaced from one another a sufficient distance to support the bulbous end above the bottom of the trough while permitting the narrow end to be laterally deflected as it passes downwardly along the chute to come to rest in the trough thereby to laterally offset the narrow end with respect to the bulbous end of the bulb prior to discharge through the open discharge end of the trough.

2. A load orienting receptacle as claimed in claim 1 wherein said slipway further comprises a bulb seating portion extending from the bulb orienting portion to the discharge end, said chute extending into said seating portion and progressively diminishing in size in a direction toward and terminating short of said discharge end thereby to permit the bulbous end to be lowered to rest on the bottom wall as it is driven longitudinally through said trough to be discharged through said discharge end in use.

3. A load orienting receptacle as claimed in claim 1 wherein said trough comprises; a bottom wall and a pair of oppositely disposed side walls, said chute being in the form of a ramp which extends downwardly from one side wall of the trough toward the bottom wall of the trough, said ramp being spaced from the other side of the trough to support the bulbous end above the bottom while directing the narrow end laterally toward the other side wall, said ramp extending into said seating portion and progressively diminishing in size in a direction toward and terminating short of said discharge end thereby to permit the bulbous end to be lowered to rest on the bottom wall as it is driven longitudinally through said trough to be discharged through said discharge end in use.

4. In a carton loading machine for end loading cartons having a carton conveyor mounted for longitudinal movement through a loading station, the improvement of;

(a) a plurality of carton support means on said carton loading conveyor for supporting a carton with both ends thereof opening laterally one on either side of said loading conveyor, (b) a pair of loading conveyors mounted one on either side of the carton conveyor and extending through said loading station, (c) a plurality of loading receptacles mounted on said loading conveyor, said receptacles being arranged in oppositely disposed aligned pairs one on either side of said carton support means in said loading station, each of said loading receptacles having a discharge end opening toward said carton support means and a slipway extending to the discharge end, said slipway being adapted to laterally deflect the leading end of the load located in one receptacle of a pair of receptacles out of alignment with the leading end of the load located in the other receptacle of said pair of receptacles prior to discharge of said loads through said discharge end, (d) load discharging means mounting for longitudinal movement relative to said loading receptacles for driving said load longitudinally of said slipway through said discharge end and into said carton support means.

5. A carton loading machine as claimed in claim 1 wherein each loading receptacle is adapted for use in loading lightbulbs of the type having a bulbous end and a narrow plug end, and wherein each receptacle comprises;

a trough in which said slipway is forward, said slipway having an open upper end for admitting a lightbulb to a load orienting portion thereof spaced inwardly from the discharge end, said load orienting portion having opposite sides which converge downwardly to form a downwardly directed laterally inclined chute, said opposite sides being spaced from one another a sufficient distance to support the bulbous end above the bottom of the trough while permitting the narrow end to be laterally deflected as it passes downwardly along the chute to come to rest in the trough thereby to laterally offset the narrow end with respect to the bulbous end of the bulb prior to discharge through the open discharge end of the trough.

6. A carton loading machine as claimed in claim 5 wherein said slipway further comprises a bulb seating portion extending from the bulb orienting portion to the discharge end, said chute extending into said seating portion and progressively diminishing in size in a direction toward and terminating short of said discharge end thereby to permit the bulbous end to be lowered to rest on the bottom wall as it is driven longitudinally through said trough to be discharged through said discharge end in use.

7. A carton loading machine as claimed in claim 5 wherein each trough comprises; a bottom wall and a pair of oppositely disposed side walls, said shute being in the form of a ramp which extends downwardly from one side wall of the trough toward the bottom wall of the trough, said ramp being spaced from the other side of the trough to support the bulbous end above the bottom while directing the narrow end laterally toward the other side wall, said ramp extending into said seating portion and progressively diminishing in size in a direction toward and terminating short of said discharge end thereby to permit the bulbous end to be lowered to rest on the bottom wall as it is driven longitudinally through said trough to be discharged through said discharge end in use.

* * * * *